US005535683A

United States Patent [19]

Novak

[11] Patent Number: 5,535,683

[45] Date of Patent: Jul. 16, 1996

[54] CARRYING CASE CONVERTIBLE INTO PORTABLE TABLE

[75] Inventor: Leslie A. Novak, Newburyport, Mass.

[73] Assignee: Howda Designz, Inc., Newbury, Mass.

[21] Appl. No.: 293,059

[22] Filed: Aug. 19, 1994

[51] Int. Cl.[6] ..... A47B 3/00

[52] U.S. Cl. ..... 108/36; 108/35; 108/11; 220/754

[58] Field of Search ..... 108/36, 35, 34, 108/11, 130, 129; 16/125, 126, 110.5, 114 R, 114 B, 115; 220/754

[56] References Cited

U.S. PATENT DOCUMENTS

| | | | |
|---|---|---|---|
| 517,756 | 4/1894 | Maurer | 108/35 |
| 2,326,461 | 8/1943 | Howe | 108/36 |
| 2,433,315 | 12/1947 | Bicszki | 108/36 |
| 2,436,730 | 2/1948 | Repke | 108/35 X |
| 2,673,774 | 3/1954 | DiPrima | 108/36 |
| 2,693,258 | 11/1954 | Fleisch | 108/36 X |
| 3,734,336 | 5/1973 | Rankow et al. | 220/754 X |
| 4,333,638 | 6/1982 | Gillotti | 108/36 X |
| 4,943,041 | 7/1990 | Romein | 108/36 X |

FOREIGN PATENT DOCUMENTS

| | | | |
|---|---|---|---|
| 400752 | 8/1909 | France | 108/36 |
| 2394459 | 2/1979 | France | 16/125 |

*Primary Examiner*—Peter M. Cuomo
*Assistant Examiner*—Janet M. Wilkens
*Attorney, Agent, or Firm*—Zarley, McKee, Thomte, Voorhees & Sease

[57] ABSTRACT

A carrying case convertible into a table includes a lid portion matingly and hingedly connected to a bottom portion so that an interior space is formed between the lid portion and the bottom portion in a closed position such that items can be stored and carried. One or more legs having dimensions that fit within the interior space are attached to at least one of the case portions. The legs are positioned so as to support one or both of the case portions in a substantially horizontal orientation.

8 Claims, 4 Drawing Sheets

CARRYING CASE CONVERTIBLE INTO PORTABLE TABLE

BACKGROUND OF THE INVENTION

The present invention transcends two seemingly unrelated and distinct fields of art. The present invention relates to the field of carrying cases, especially briefcases, attaché cases and the like. This invention also relates to the field of portable tables for bed trays, picnics and the like. More particularly, the present invention relates to a carrying case which converts into a portable picnic table.

Picnics have long been a popular pastime. Picnics are a common way for families to celebrate, especially at family reunions. At large picnics, picnic tables are generally needed to seat the guests. Catering to this need in the community, most parks usually provide large, essentially stationary picnic tables at conspicuous locations. Such conventional tables work well for family or group gatherings, but are not portable.

Furthermore, some romantically inclined picnickers desire more privacy for their picnics. Consequently, these picnickers tend to seek out more secluded and intimate settings for their picnics. Unfortunately, a more intimate setting can often mean a lack of picnic tables at which to eat. It is known in the art to picnic while sitting or reclining on a blanket or on the grass, but this is not particularly conducive to eating in a dignified manner. Also, unwanted picnic guests such as ants, other insects, and the like are more likely to invite themselves to the meal if the food is placed close to the ground. Spills and stains can break the mood of the moment if a stable surface is not provided on which to place plates, utensils, food and drinks.

In addition to the need for a stable eating surface, there is also a need to transport and store the various picnic items, such as beverages, eating utensils, a blanket, and even portable seats like those described in U.S. Pat. No. 5,100,203 issued to this inventor on Mar. 31, 1992. Conventional folding table chair sets, such as the one disclosed in U.S. Pat. No. 1,936,969, are bulky, heavy, prone to rust, and lack internal storage capacity. Breakfast trays or bed trays are known to be useful in meeting the dining needs of persons in bed, but they also lack internal storage capacity.

Picnic baskets and coolers can be used to transport items to a picnic and may even provide a small table surface of sorts. However, these baskets and coolers are generally bulky and awkward to carry. Also, when sitting at the makeshift table, the picnicker has to either awkwardly straddle the makeshift table or sit far way because no leg room is provided under the table.

There is a need for a hand-held or shoulder-held carrying case in which to carry items to and from the picnic site. Furthermore, a portable table is needed at the picnic area. Therefore, it is a primary objective of this invention to provide a carrying case which converts into a portable picnic table.

Another objective of the present invention is to provide a stable portable picnic table with legs that extend downwardly and outwardly so as to elevate the table surface to a convenient height for the user who is seated or lying on the same surface on which the legs rest.

Another objective of the present is to provide a portable picnic table which converts into a carrying case for carrying articles to and from the picnic.

Another objective of this invention is to provide a carrying case in which a bottled food or beverage, such as wine or soft drinks, may be carried to a picnic site.

Another objective of the present invention is to provide a carrying case with one or more handles or shoulder straps by which the picnicker may carry the case.

Another objective of the present invention is to provide a carrying case/portable picnic table which is lightweight and convenient for a person to carry.

Another objective of this invention is to provide a carrying case/portable picnic table which is economical to manufacture and safe and durable in use.

These and other objects will become apparent from the following description of the invention.

SUMMARY OF THE INVENTION

The present invention relates to a carrying case, such as a briefcase, attaché case or the like, which is convertible into a table. In the portable table mode, the present invention is useful in many ways, including but not limited to use as a picnic table, a bed tray, and a TV tray. In the carrying case mode, items can be stored and transported in the case.

The carrying case includes a bottom portion and a lid portion matingly and hingedly connected to the bottom portion such that an interior space for storing and carrying items is formed therebetween when they are pivoted together into a closed position. One or more vertical risers or legs, dimensioned small enough to fit within the interior space, are attached to at least one of the case portions. The legs are positionable so as to support one or both of the case portions to provide a substantially horizontal surface for eating disposed above a mounting surface.

The carrying case has one or more handles or shoulder straps which facilitate its being transported manually. A rigid top wall in the lid portion and a rigid bottom wall in the bottom portion can be utilized to protect the contents of the case. Furthermore, the top wall and bottom wall may be constructed of materials from renewable sources such as wood. Wooden slats can be used to make the case rigid yet lightweight to carry.

In one embodiment of this invention, a vertical riser comprising two legs interconnected by crossbar is pivotally mounted inside one portion of the carrying case and another identical vertical riser is similarly mounted inside the other portion of the case. The vertical risers pivot outwardly in the same direction that the case portions pivot open. To provide greater stability and more lateral leg room under the table, the risers can be positioned opposing each other at obtuse angles with respect to the horizontal surface for eating. Furthermore, stops such as hook-and-eye type latches can be used to secure the risers to the case portions. Thus, the stops rigidly lock the risers and case portions into the table mode.

The size of the carrying case is about the same as a briefcase or attaché case. Thus, the carrying case is easy to carry. However, the carrying case is large enough to house one or two portable seats like those shown in my U.S. Pat. No. 5,100,203. Although transportable within the carrying case of this invention, these seats do not form an integral part of the portable picnic table. However, these seats are useful accessories thereto.

DETAILED DESCRIPTION OF THE PREFERRED EMBODIMENTS

Figure 1:
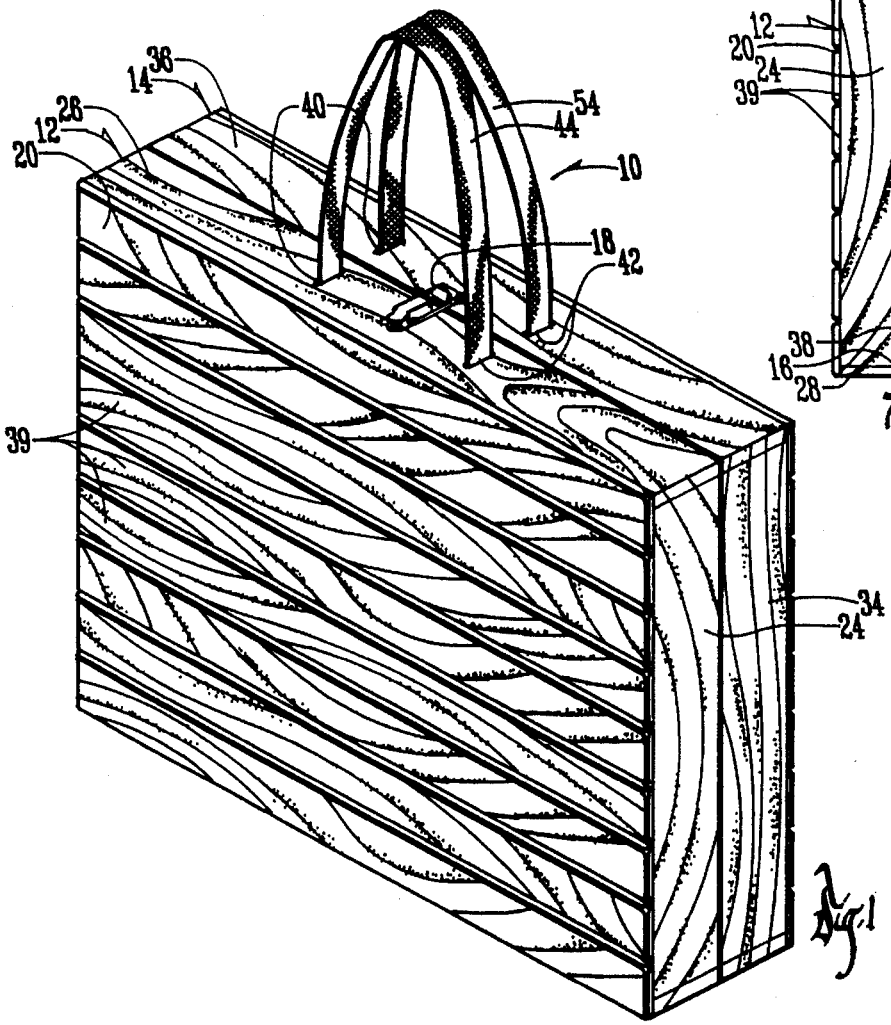
FIG. 1 is a perspective view of an embodiment of a carrying case/portable table according to the present invention in the carrying case mode.
Figure 4:
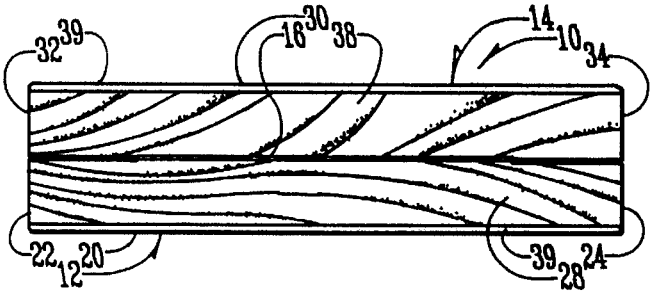
FIG. 4 is a bottom view of the carrying case/portable table of FIG. 1 showing the hinge connecting the lid to the bottom portion of the carrying case/portable table.
Figure 5:
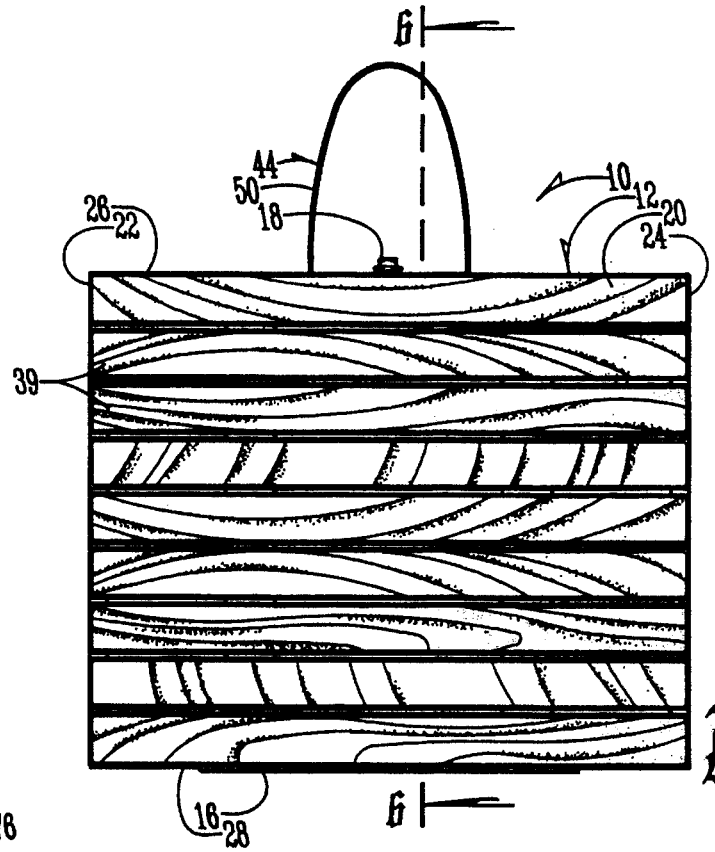
FIG. 5 is a front elevation view of the carrying case/portable table of FIG. 1.

An embodiment of a carrying case/portable table according to the present invention is denoted by reference numeral 10 in the discussion below and in the drawings. In FIG. 1, the carrying case/portable table 10 is shown in a closed and latched carrying case mode. The carrying case/portable table 10 has a bottom portion 12 and a lid portion 14 which are shown in the front and rear respectively in FIG. 1. A hinge 16 (see FIGS. 4, 7, and 10) connects lid portion 14 with bottom portion 12 so that the portions may pivot with respect to one another. Referring again to FIG. 1, a latch 18 is provided generally opposite hinge 16 for securing the portions 12 and 14 together in the carrying case mode.

Figure 2:
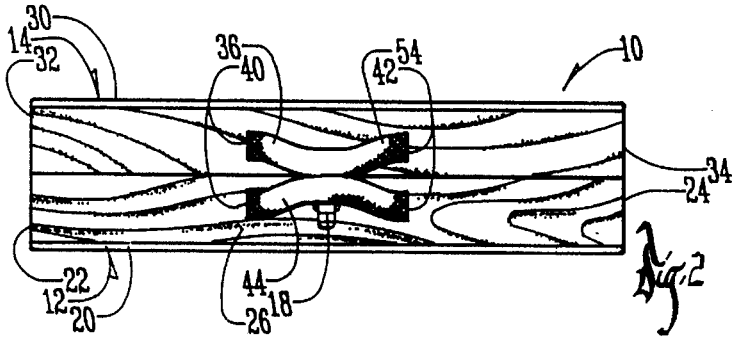
FIG. 2 is a top plan view of the carrying case/portable table of FIG. 1.
Figure 3:
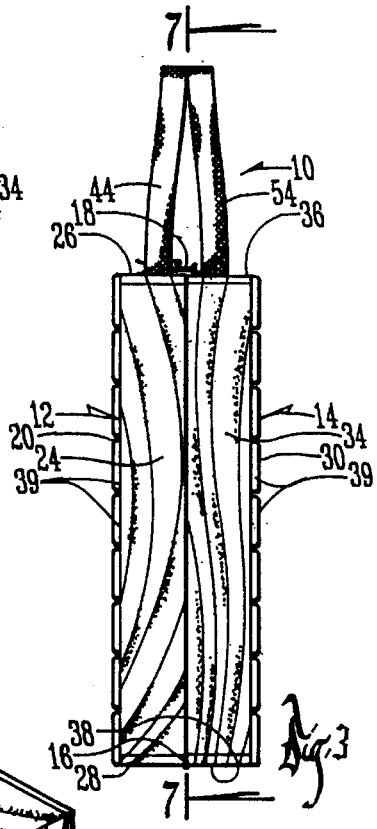
FIG. 3 is a side elevation view of the carrying case/portable table of FIG. 1.

As best seen in FIGS. 2 and 3, the bottom portion 12 includes a rigid bottom wall 20, opposing side walls 22 and 24, and opposing end walls 26 and 28. Similarly, lid portion 14 comprises a rigid top wall 30, opposing side walls 32 and 34, and opposing end walls 36 and 38. While the bottom and lid portions appear rectangular in the figures, other shapes are contemplated and suitable so long as the bottom portion 12 and lid portion 14 are adapted to mate with one another. Preferably, the rigid bottom wall 20 and rigid top wall 30 are constructed with horizontally elongated and spaced apart wooden slats 39 so as to make the carrying case lightweight and permeable to air. Wood is preferred because it comes from renewable resources.

Figure 7:
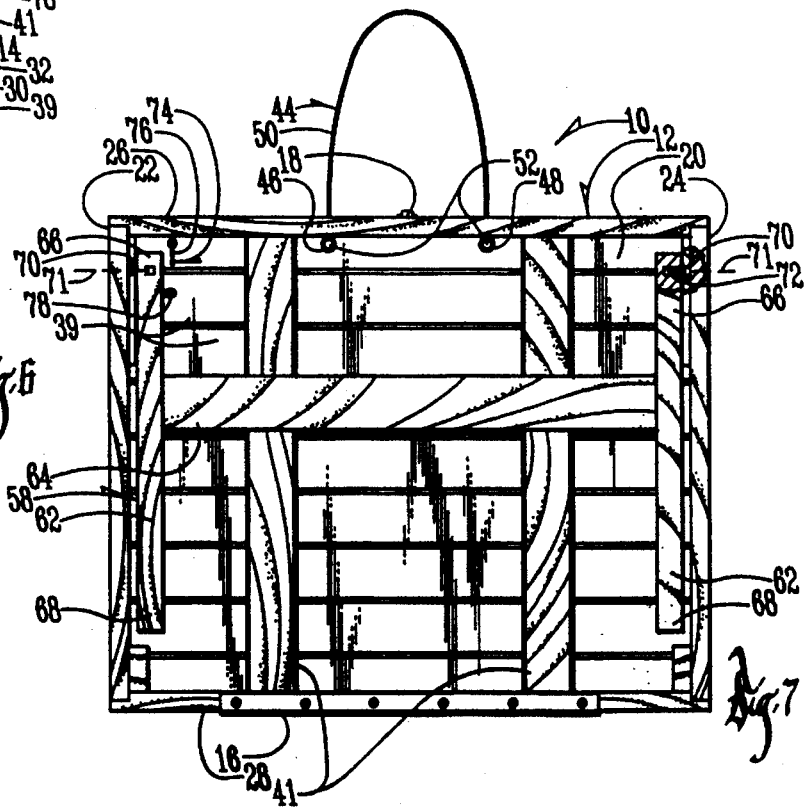
FIG. 7 is a view of the interior of the bottom portion of the carrying case/portable table of FIG. 1 taken along a line 7—7 in FIG. 3.
Figure 10:
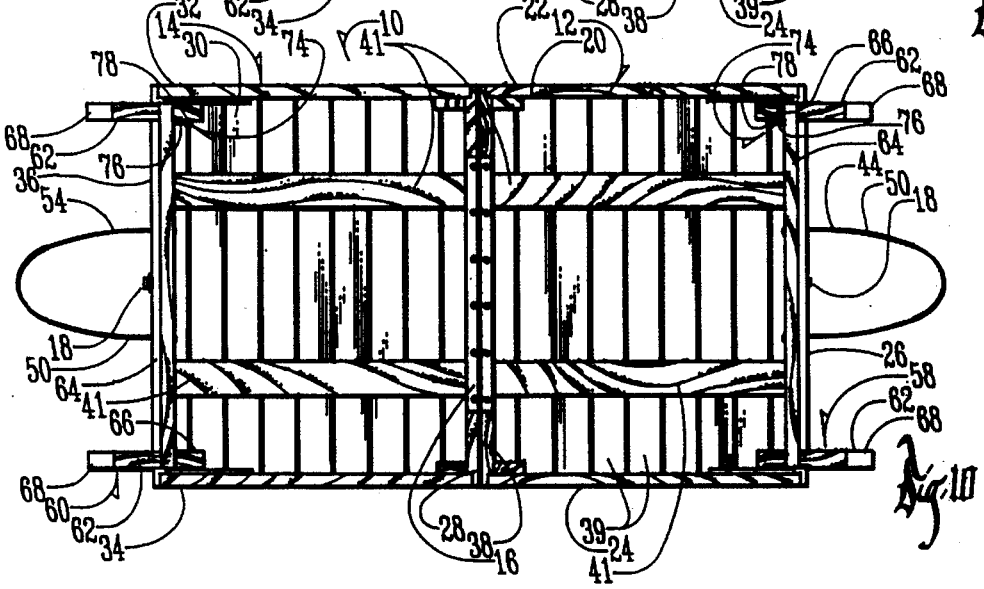
FIG. 10 is a bottom view of the carrying case/portable table of FIG. 8.

As best seen in FIGS. 7 and 10, one or more slat ribs 41 extend transversely across the horizontal slats 39 of top wall 20 and bottom wall 30 and are attached thereto. This structure lends added support and stability to the walls 20 and 30. Preferably, slat ribs 41 are disposed inside carrying case/portable table 10 as shown to avoid having protrusions on the outside of briefcase/portable table 10, especially on the table top of carrying case/portable table 10.

Figure 6:
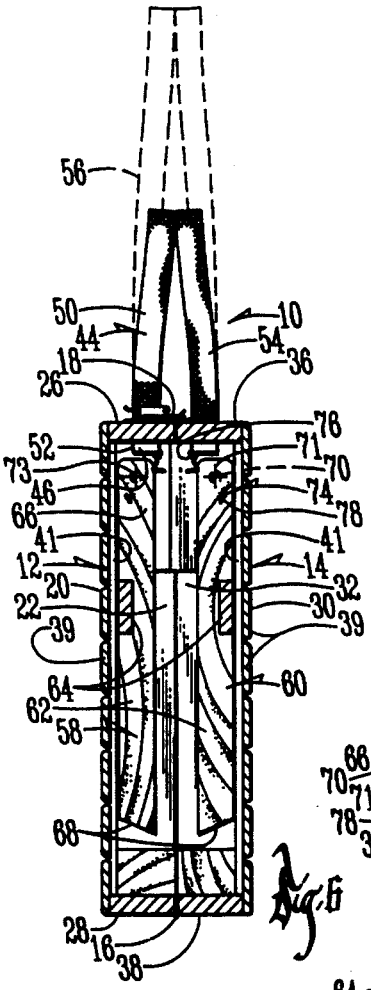
FIG. 6 is a sectional view of the carrying case/portable table of FIG. 1 taken along line 6—6 in FIG. 5.

The end wall 26 of bottom portion 12 has two spaced apart slits 40 and 42 extending therethrough. As described below, slits 40 and 42 receive and attach a first cotton web handle 44 to the bottom portion 12. FIGS. 6 and 7 show that the first handle 44 has an end 46 at which the fabric is wrapped around a dowel pin 52 and attached to itself by conventional means such as sewing. Dowel pin 52 has a diameter greater than the width across either slit 40 or 42. Thus, dowel pin 52 effectively prevents the looped end 46 from passing through the slits 40 or 42. A second looped end 48 is similarly passed through slit 42, wrapped and sewn around a dowel pin 52, and thereby kept from being withdrawn through the slit. An intermediate portion 50 extends outside bottom portion 12 between slits 40 and 42.

In other words, the first looped end 46 and the second looped end 48 are inserted through slits 40 and 42, respectively. Dowel pins 52 are inserted therein to firmly attach first handle 34 to the bottom portion 12. The intermediate portion 50 extends outside the bottom portion 12 so that a person may grab the exposed portion to move the carrying case 10.

Preferably a second handle 54, similarly constructed and mounted, is provided on the lid portion 14 of the carrying case 10 as well. The second handle 54 helps balance the carrying case 10 in a substantially vertical orientation. Furthermore, the second handle 54 provides a measure of safety through redundancy and avoids having all of the load placed on handle 44.

In another embodiment, the handles 44 and 54 can be longer to allow the user to carry the carrying case/portable table on their shoulder. It is also contemplated that a single or double shoulder strap may supplement or completely replace handles 44 and 54.

Figure 13:
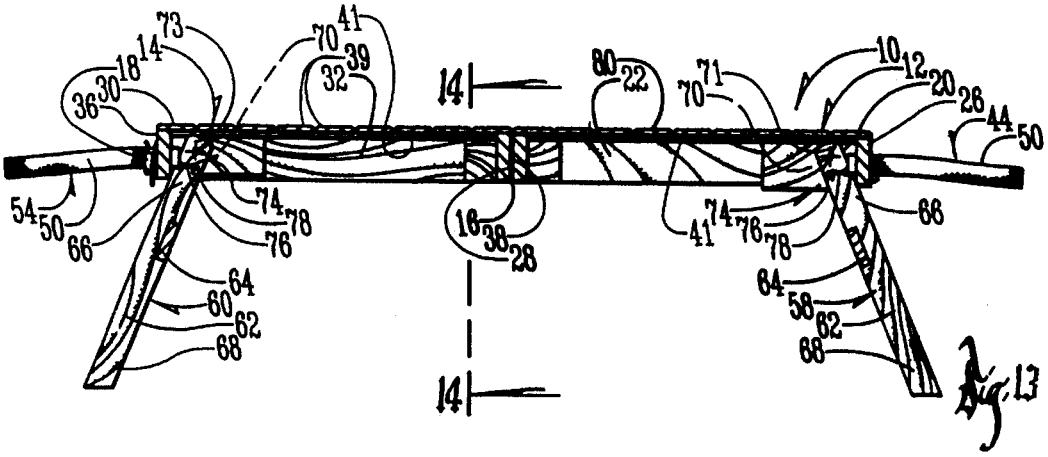
FIG. 13 is a sectional view taken along line 13—13 in FIG. 11.
Figure 14:
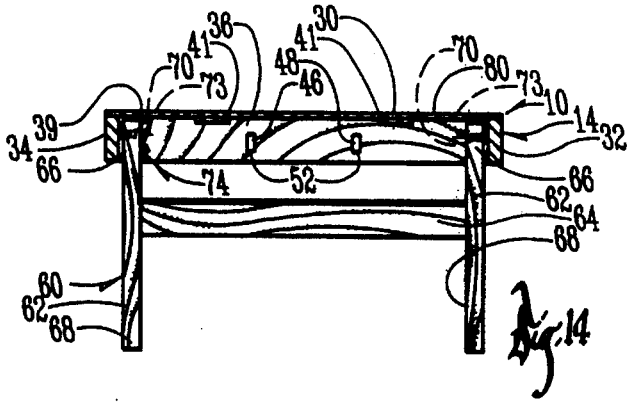
FIG. 14 is a sectional view taken along line 14—14 in FIG. 13.

Referring to FIGS. 6, 7, and 10, bottom portion 12 has a first vertical riser 58 pivotally mounted thereto and sized so as to be disposed inside of portion 12 in the carrying case mode. The lid portion 14 has a second vertical riser 60 similarly sized, mounted and disposed therein. Vertical risers 58 and 60 each comprise a pair of spaced apart legs 62 with a cross bar 64 extending therebetween for added strength and rigidity. As best seen in FIG. 13, the legs 62 have upper ends 66 which are pivotally mounted to the respective portion 12 or 14.

More particularly, each upper end 62 is pivotally connected to the adjacent side wall 26 or 36 by conventional means, such as a pivot pin 70 which engages a bushing bore 72 (see FIG. 1). Other well known arrangements such as an axle rod or bolt will also suffice. The pivotal mounting of the risers takes place adjacent to the end walls 26 or 36 so that the risers 58 and 60 pivot towards each other to lie flat in the bottom portion 12 and lid portion 14 respectively in the carrying case mode. The risers 58 and 60 pivot respectively about substantially parallel horizontal axes 71 and 73 (see FIGS. 7 and 13). Axes 71 and 73 are also generally parallel to the operating axis of hinge 16.

Figure 8:
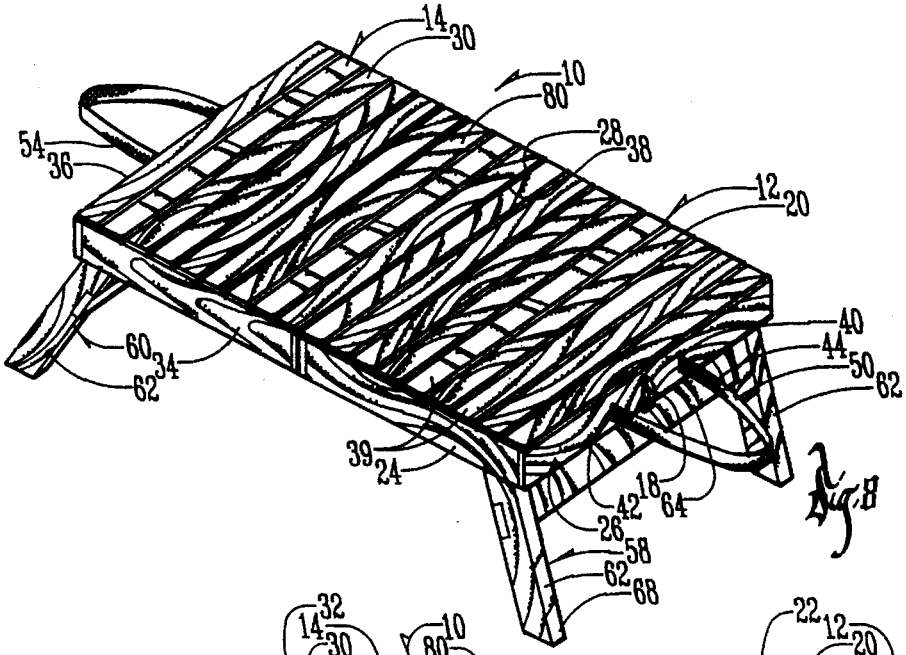
FIG. 8 is a perspective view of a carrying case/portable table of FIG. 1 having legs extended according to the present invention so as to define a table mode.
Figure 9:
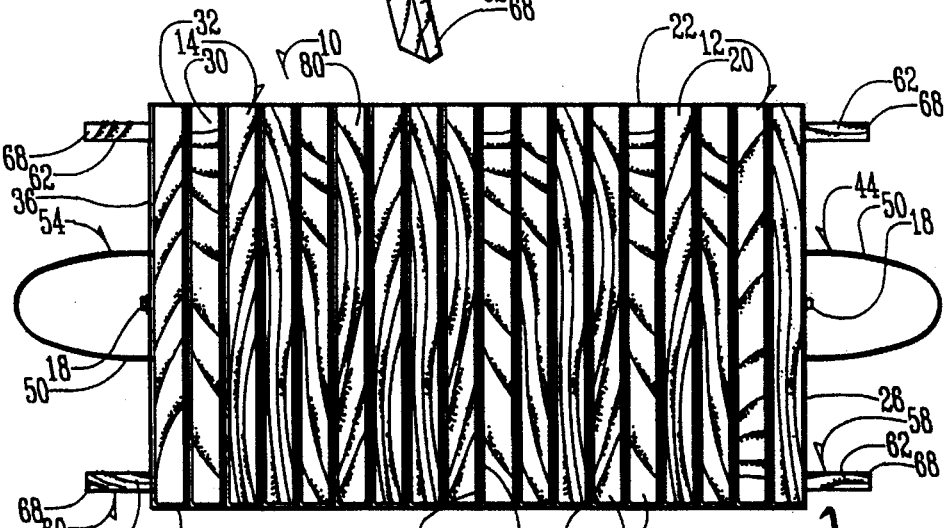
FIG. 9 is a top plan view of the carrying case/portable table of FIG. 8.

Each leg 62 also has a lower end 68 which is preferably mitered for better contact with the ground when the carrying case/portable table 10 is folded out into the table mode (see FIG. 8). As shown in FIGS. 6 and 13, the upper ends 66 have rounded corners to provide the necessary clearance to allow the legs 62 to pivot freely between the fully extended and fully stowed positions. The legs 62 preferably abut end wall 26 or 36 when pivoted outwardly, thereby being stopped in a fully extended position. Preferably, the vertical risers 58 and 60 are spaced away from end walls 26 and 36 respectively such that the risers form an obtuse angle with the walls 20 or 30 when fully extended.

Preferably, a stop, such as a hook-and-eye type latch 74, is interposed between each portion 12 and 14 and the vertical risers 58 and 60 respectively attached thereto to secure them in position once the riser is fully extended (see FIG. 13). Latch 74 includes a hook 76 mounted on leg 62 and an eye 78 mounted on portion 12 or 14 for receiving hook 76. This conventional hook-and-eye type latch 74 keeps the riser 58 or 60 secured in a downwardly extended position, thus providing a stable horizontal picnic surface 80 in the table mode.

In use, the carrying case/portable table 10 is sized so as to provide ample space inside, i.e. between the bottom walls of portion 12 and lid portion 14, to store various items for use at a picnic. Such items include, but are not limited to, a bottle of wine, plates, eating utensils, napkins, a tablecloth, sandwiches or other food, canned or bottled soft drinks, cups, and even portable seats like those described in U.S. Pat. No. 5,100,203 issued to this inventor on Mar. 31, 1992.

To prepare for a picnic, the user simply packs the desired items inside the carrying case 10, pivots the lid portion 14 against the bottom portion 12, and secures them together with latch 18. The rigid walls of the carrying case/portable table 10 help protect the contents. The carrying case/portable table 10 is easily transportable in the trunk or backseat of an automobile.

Upon arriving at the picnic site, the picnicker lays carrying case/portable table 10 on the ground with the bottom wall 20 facing downward. Then the picnicker opens latch 18 and pivots the lid portion 14 away from bottom portion 12 to expose the contents. After removing and temporarily setting aside the picnic provisions, the picnicker pivots the lid portion 14 away from the bottom portion 12 until the top wall 30 is coplanar with the bottom wall 20. At this point, both the bottom wall 20 and the top wall 30 rest on the ground and the vertical risers 58 and 60 inside of carrying case/portable table 10 can be moved.

Figure 11:
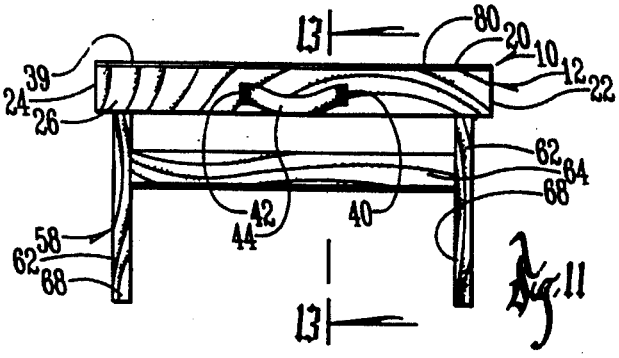
FIG. 11 is a side elevation view of the carrying case/portable table of FIG. 8.
Figure 12:
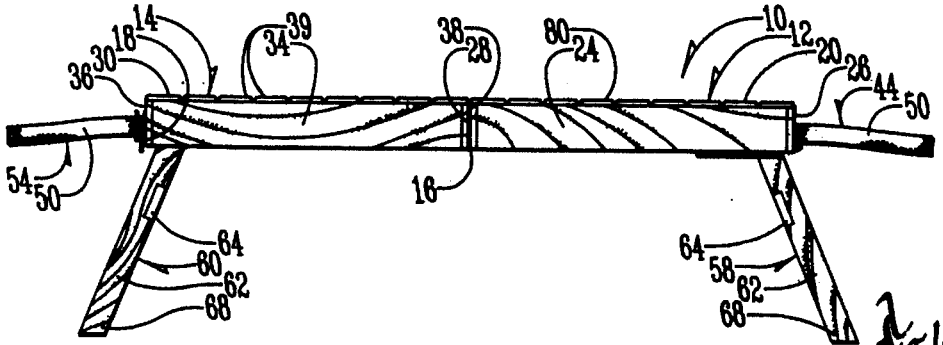
FIG. 12 is a front elevation view of the carrying case/portable table of FIG. 8.

Next, the picnicker pivots the first vertical riser 58 away from the bottom portion 12 until it abuts wall 26. Thereafter, latch 74 is used to secure riser 58 in its fully extended position. The picnicker then pivots the second vertical riser 60 away from the lid portion 14 until it abuts wall 36 and secures it with the latch 74. The carrying case has been transformed into a portable picnic table by pivoting both vertical risers 58 and 60 into their fully extended positions and subsequently securing them. The carrying case/portable table 10 is then lifted and oriented so that the lower ends 68 of the legs 62 sit firmly on the ground. With legs 62 resting on the ground, the top wall 30 of the lid portion 14 and the bottom wall 20 of the bottom portion 12 are coplanar and form a substantially horizontal picnic surface 80, as shown in FIG. 8. Picnic provisions can be set on this horizontal picnic surface 80 and the picnic may commence, even if the location is somewhat secluded, primitive, and lacks full size picnic tables. It should be noted that the carrying case/portable picnic table 10 is constructed and sized so that the lower bodies of one or more persons can fit under it in the portable table mode. As best seen in FIGS. 8, 11, and 12, in the table mode, the present invention provides an unobstructed volume having a generally trapezoidal prism shape defined by the risers 58, 60, the lower edges of the lid and bottom portions 12, 14, and the ground. Thus, the present invention sets the stage (or the table) for a romantic picnic for two.

Another contemplated use of the present invention is as a portable bed tray. In its portable table mode the carrying case/portable table 10 can be extended transversely across a person's bed. When extended and locked in place, the vertical risers 58 and 60 rest on either side of the person's lower body and on the bed so as to support the horizontal picnic surface 80 which extends over the person's legs. Vertical risers 58 and 60 are of sufficient height to allow a person's legs to extend under the horizontal picnic surface 80. The extension of vertical risers 58 and 60 at an obtuse angle from the horizontal picnic surface 80 provides the users with additional lateral leg room under the portable table.

Whereas the invention has been shown and described in connection with the preferred embodiments thereof, it will be understood that substitutions and additions may be made which are within the intended broad scope of the following claims. From the foregoing, it can be seen that the present invention accomplishes at least all of the stated objectives.

What is claimed is:

1. A carrying case/portable table, comprising;

a bottom portion including a rigid bottom wall and opposing first and second end walls attached to the bottom wall;

a lid portion including a rigid top wall and opposing first and second end walls attached to the top wall, the first end wall of the bottom portion being pivotally connected to the first end wall of the lid portion opposite the top wall, the lid portion being adapted for alignment and abutment with the bottom portion in a carrying case mode wherein the top wall and the bottom wall are spaced apart so as to define a top interior volume and a bottom interior volume between the end walls and the top wall and the bottom wall respectively;

a first vertical riser pivotally mounted in the bottom interior volume adjacent the second end wall of the bottom portion, the first vertical riser being pivotal in a counterclockwise direction with respect to the bottom wall of the bottom portion so that in an extended position the first vertical riser forms an obtuse angle with respect to the bottom wall;

a second vertical riser pivotally mounted in the top interior volume adjacent the second end wall of the lid portion, the second vertical riser being pivotal in a clockwise direction so as to form an obtuse angle with respect to the top wall of the lid portion;

the first and second vertical risers being dimensioned so as to fit in a stowed position between the lid portion and the bottom portion in the carrying case mode and yet leaving carrying volume for picnic items in the top and bottom interior volumes respectively;

the bottom portion and the lid portion are pivotable about 180° apart from each other such that the top wall and the bottom wall become generally coplanar with each other so as to form a substantially horizontal picnic surface having a fixed area;

the first and second vertical risers being extendible downwardly and outwardly beyond a vertical projection of the picnic surface to support the picnic surface above a supporting surface in the table mode;

in the table mode the bottom and lid portions respectively including lower edges; the first and second risers, the lower edges of the bottom and lid portions, and the supporting surface all defining therebetween an unobstructed volume generally shaped as a trapezoidal prism, the unobstructed volume being adapted for receiving a lower body of a picnicker.

2. The carrying case/portable table of claim 1 wherein the first and second vertical risers are adapted to fit within the respective portions to which the risers are mounted and each comprise a pair of spaced apart legs and a crossbar interconnecting the legs within each pair such that the legs of each riser pivot together in unison.

3. The carrying case/portable table of claim 1 wherein the top wall and the bottom wall are constructed of a plurality of spaced apart wooden slats.

4. The carrying case/portable table of claim 1 further comprising a pair of stops, one mounted to the lid portion and another mounted to the bottom portion, for operatively securing each vertical riser against movement with respect to the respective portion.

5. The carrying case/portable table of claim 4 wherein each stop comprises a hook-and-eye type latch for selectively connecting the riser and the respective portion so as to lock the riser in a downwardly extended position.

6. The carrying case/portable table of claim 4 wherein the stops are positioned to stop the vertical risers at an obtuse angle with respect to the substantially horizontal picnic surface when the risers are pivoted outwardly in the table mode.

7. The carrying case/portable table of claim 1 further comprising a handle/shoulder strap for carrying the carrying case/portable table, the strap being attached to one of the portions.

8. A carrying case/portable table, comprising;

a bottom portion including a rigid bottom wall and opposing first and second end walls attached to the bottom wall;

a lid portion including a rigid top wall and opposing first and second end walls attached to the top wall, the first end wall of the bottom portion being pivotally connected to the first end wall of the lid portion opposite the top wall, the lid portion being adapted for alignment and abutment with the bottom portion in a carrying case mode wherein the top wall and the bottom wall are spaced apart so as to define a top interior volume and a bottom interior volume between the end walls and the top wall and the bottom wall respectively;

a first vertical riser pivotally mounted in the bottom interior volume adjacent the second end wall of the bottom portion, the first vertical riser being pivotal in a counterclockwise direction with respect to the bottom wall of the bottom portion so that in an extended position the first vertical riser forms an obtuse angle with respect to the bottom wall;

a second vertical riser pivotally mounted in the top interior volume adjacent the second end wall of the lid portion, the second vertical riser being pivotal in a clockwise direction so as to form an obtuse angle with respect to the top wall of the lid portion;

the first and second vertical risers being dimensioned so as to fit in a stowed position between the lid portion and the bottom portion in the carrying case mode and yet leaving carrying volume for picnic items in the top and bottom interior volumes respectively;

the bottom portion and the lid portion are pivotable about 180° apart from each other such that the top wall and the bottom wall become generally coplanar with each other so as to form a substantially horizontal picnic surface having a fixed area;

the first and second vertical risers being extendible downwardly and outwardly beyond a vertical projection of the picnic surface to support the picnic surface in the table mode;

the first and second risers and the bottom and lid portions in the table mode defining an unobstructed volume thereunder adapted for receiving a lower body of a picnicker, the unobstructed volume having a cross-sectional area in a horizontal plane at least equal to the fixed area of the picnic surface; and a handle/shoulder strap for carrying the carrying case/portable table, the strap being attached to one of the portions and the one of the portions having a pair of spaced apart slits through one of the side walls thereof, the strap including an elongated band having a first looped end spread by a first dowel pin, and intermediate portion extending outwardly through one of the slits and then extending inwardly through the other of the slits, and a second looped end terminating the intermediate portion and spread by a second dowel pin.

* * * * *